US006491242B1

(12) United States Patent
Dingee, IV et al.

(10) Patent No.: US 6,491,242 B1
(45) Date of Patent: Dec. 10, 2002

(54) MALLEABLE MATERIAL REDUCTION

(75) Inventors: H. Clay Dingee, IV, Midlothian, TX (US); David Watson, Avalon, TX (US); John E. Teague, Mansfield, TX (US)

(73) Assignee: GulfTex Environmental Services LLC, Mansfield, TX (US)

( * ) Notice: Subject to any disclaimer, the term of this patent is extended or adjusted under 35 U.S.C. 154(b) by 0 days.

(21) Appl. No.: 09/617,540

(22) Filed: Jul. 14, 2000

(51) Int. Cl.[7] ..... B02C 19/06
(52) U.S. Cl. ..... 241/39; 241/79.1
(58) Field of Search ..... 241/5, 39, 79.1

(56) References Cited

U.S. PATENT DOCUMENTS

| | | | | |
|---|---|---|---|---|
| 3,794,251 A | | 2/1974 | Williams | |
| 4,186,772 A | * | 2/1980 | Handleman | 241/5 |
| 5,236,132 A | | 8/1993 | Rowley, Jr. | |
| 5,598,979 A | * | 2/1997 | Rowley | 241/5 |
| 5,637,152 A | | 6/1997 | Robinson et al. | |
| 5,727,740 A | | 3/1998 | Robinson et al. | |
| 5,902,224 A | | 5/1999 | Bloom | |

* cited by examiner

*Primary Examiner*—Mark Rosenbaum
(74) *Attorney, Agent, or Firm*—Nixon & Vanderhye P.C.

(57) ABSTRACT

Malleable material, such as manure, and municipal sludge, food waste, and the like, is dried and the average particle size of the material is reduced in a simple and effective manner without the use of an external heat source. The material with a first moisture content and average particle size is fed into an air stream, and the speed of the air flow with entrained particles is increased so that it is super-cyclonic, typically have a bullet profile with a substantially zero velocity at the periphery of the air flow and a velocity of about 400–500 mph at the center of the air flow. The material is then caused to be reduced in particle size by material to material collisions in one or more cyclone-shaped vessels with retention air-affecting inlets at bottom portions thereof, and the speed of the air flow with entrained material is ultimately reduced so that substantially the entire flow is below super-cyclonic speed. Then the material, having a second moisture content at least 20% less than the first moisture content (e.g. less than one-quarter of the first moisture content), and a second average particle size significantly less than the first size, is separated from the air flow, e.g. by using a cyclone separator with the air flow inlet tangentially into a top portion thereof, the particle outlet at the bottom, and an exhaust gas outlet at the top. The gas out flow form the top may be subjected to wet scrubbing or other treatment.

7 Claims, 10 Drawing Sheets

MALLEABLE MATERIAL REDUCTION

BACKGROUND AND SUMMARY OF THE INVENTION

There is a need in many industries to economically recover valuable products from what are considered to be wastes having a high moisture content and a non-uniform particle size. It is desirable to recover valuable products with greatly reduced moisture content, substantially uniform size, and without significant loss of beneficial attributes of the material. These industries include the agricultural, food processing, mining, coal, pulp and paper, and oil and gas industries. As one example, in livestock feed lots raw manure is produced in large volumes, and the most common reutilization mechanism is to apply it to land in the same water shed. However, such operations have become an environmental concern for a number of reasons, and in view of the large volume of manure produced (e.g. estimated to be about 1.4 billion tons of manure in the U.S.A. alone in 1998), stockpiles of manure and other waste products are becoming a significant cause for concern.

While presently a cause for concern, raw manure, when properly processed, has many applications. It can be used as a fertilizer, a soil amendment for such areas as parks, golf courses, and lawns, and in a number of other situations. In known systems, raw manure is typically mechanically milled or ground with hammer mills or grinders prior to processes in which the manure is dried in a rotary drum drier at between 350–500° F. using an external heat source. A roll compactor is then used to form briquettes from the pulverized and dried raw manure, which are then re-ground to a desired granule size. Such systems have a number of environmental and economic drawbacks that make them largely, or wholly, not, cost effective.

Not only is conventional processing marginally or not cost effective, it also significantly reduces the quality of the processed product. The heat used for drying not only is produced expensively and with environmental adverse consequences, but it destroys a significant amount of the organic material in the manure. Also, the forming process produces a greater volume of airborne products that can present a health and safety hazard, requiring the utilization of air pollution controls.

According to the present invention, a method and apparatus are provided that overcome the drawbacks associated with the reduction of a large variety of different types of malleable material (such as manure, municipal sludge, coal and coal fines, food wastes, pulp and paper wastes, mine tailings, and dredge spoils). The method and system according to the present invention avoid almost all of the problems associated with the prior art systems and methods. According to the present invention one can produce a product having a much lower moisture content (typically a quarter or less of the original moisture content) while significantly reducing the average particle size (e.g. by at least 20%), and making the particle size substantially more uniform. The method of the invention can be practiced without any, or much less, external heat, and the organic content of the product produced is almost high as the initial organic content, typically not being reduced by more than about 15%.

According to one aspect of the present invention there is provided a method of drying and size-reducing malleable material, comprising substantially sequentially and continuously: (a) Feeding the material with a first moisture content and first average particle size into an air stream, to entrain the material in the air stream. (b) Increasing the speed of the air flow with entrained particles so that the speed is super-cyclonic and at least some of the particles are at super-cyclonic speed. (c) Causing the material to reduce in particle size by material to material collisions. (d) Reducing the speed of the air flow with entrained material particles so that substantially the entire flow is below super-cyclonic speed. And (e) separating the material, having a second moisture content at least 20% less than the first moisture content, and a second average particle size less than the first size, from the air flow.

Preferably (a)–(e) are practiced without the use of any external heat source, and (e) takes place by cyclonic separation. The method may further comprise wet scrubbing the air flow from (e), and under some circumstances after wet scrubbing, or other treatment, at least half of the air flow discharged from (e) may ultimately be recirculated. Also, in the practice of the method, (c) is practiced in at least two different stages, with the second stage inlet located vertically higher than the first stage. Also, preferably the cyclonic separation inlet in (e) is at a location vertically above the second stage of (c).

In the typical practice of the present invention, (b) is practiced to produce a substantially bullet profile of air flow with entrained material, having a substantially zero velocity at the periphery of the air flow, and a velocity of over about 400 mph at the center of the air flow; and (b) is typically further practiced so that the air flow speed approximately mid way between the periphery and center is about 225–275 mph. The air flow may be a first air flow, and (b) may be practiced by causing the first air flow with entrained material to pass through a truncated cone so as to gradually reduce the cross-sectional area of the first air flow by at least 10%, and by introducing a second air flow surrounding the reduced cross-sectional area first air flow.

In the further implementation of the invention, typically (a)–(e) are practiced so that the second moisture content is less than about one quarter the first moisture content, and so that the second particle size is more uniform than the first particle size. Also, typically (a)–(e) are practiced using an organic material having a final organic content in (e) not more than about 15% less than the initial organic material content in (a), and wherein (a)–(e) are further practiced so that the second moisture content is less than about one quarter the first moisture content. The method may be practiced using manure as the material, or alternatively municipal sludge, coal and coal fines, food wastes, pulp and paper mill wastes, mine tailings, dredge spoils, or various combinations thereof.

In the preferred practice of the invention, (c) is practiced in at least one cyclone-shaped vessel, and further comprises directing an auxiliary flow of air into the at least one cyclone-shaped vessel to adjust material retention time in the vessel. The method may further comprise causing the material entrained in air flow to be introduced tangentially into the at least one cyclone-shaped vessel, and to impact a plurality of breaker bars in the vessel to facilitate particle size reduction.

In another aspect of the present invention a material drying and particle size-reducing apparatus is provided comprising: A blower. An air lock feeder operatively connected to receive air from the blower and downstream thereof. An accelerator for increasing the speed of air flow from the blower, with entrained material from the air lock feeder. At least one particle size reducer operatively connected to the accelerator downstream thereof. And a separator for separating reduced average particle size and drier material from the air flow, the separator operatively connected to and downstream of the at least one particle size reducer.

Preferably the material comprises a housing having a first open end operatively connected to the air lock feeder, a second open end operatively connected to the at lest one particle size reducer; a central conduit having a first end at or adjacent the housing first end, having a first diameter, and a second open end within the housing having a second diameter at least 10% less (e.g. about 30–35% less) than the first diameter; and a truncated cone portion of the central conduit between the first and second diameter portions thereof. The accelerator may further comprise a substantially annular chamber surrounding the second end of the central conduit within the housing, and a connection to the blower in the annular chamber between the first and second ends of the central conduit and at least about six inches from the central conduit second end.

In the preferred embodiment, the at least one particle size reducer comprises at least first and second cyclone-shaped vessels connected in series, the first cyclone-shaped vessel between the second cyclone-shaped vessel and the accelerator; and wherein the vessels each have an inlet and an outlet; and wherein the second vessel inlet is vertically above the first vessel inlet and the first vessel outlet is connected by a curved conduit to the second vessel inlet. Preferably the separator comprises a cyclone-shaped separator vessel with a particle outlet at a bottom portion thereof and an inlet at a top portion thereof; and wherein the separator vessel inlet is vertically above the second particle size reducer vessel and connected thereto by a curved conduit.

Also, the separator may comprise first and second air outlets from a top portion of the separator vessel, above the separator vessel inlet. The first and second cyclone-shaped vessels may also include valved auxiliary air inlets at the bottom portions thereof, the auxiliary air inlets operatively connected to the blower and the valves being adjustable to control the auxiliary air flow to control the retention time of material particles in the vessels.

It is a primary object of the present invention to provide a simple, cost effective, and energy and environmentally sound method and apparatus for processing waste products so as to reduce the moisture content and average particle size thereof. This and other objects of the invention will become clear from an inspection of the detailed description of the invention and from the appended claims.

DETAILED DESCRIPTION OF THE DRAWINGS

Figure 1:
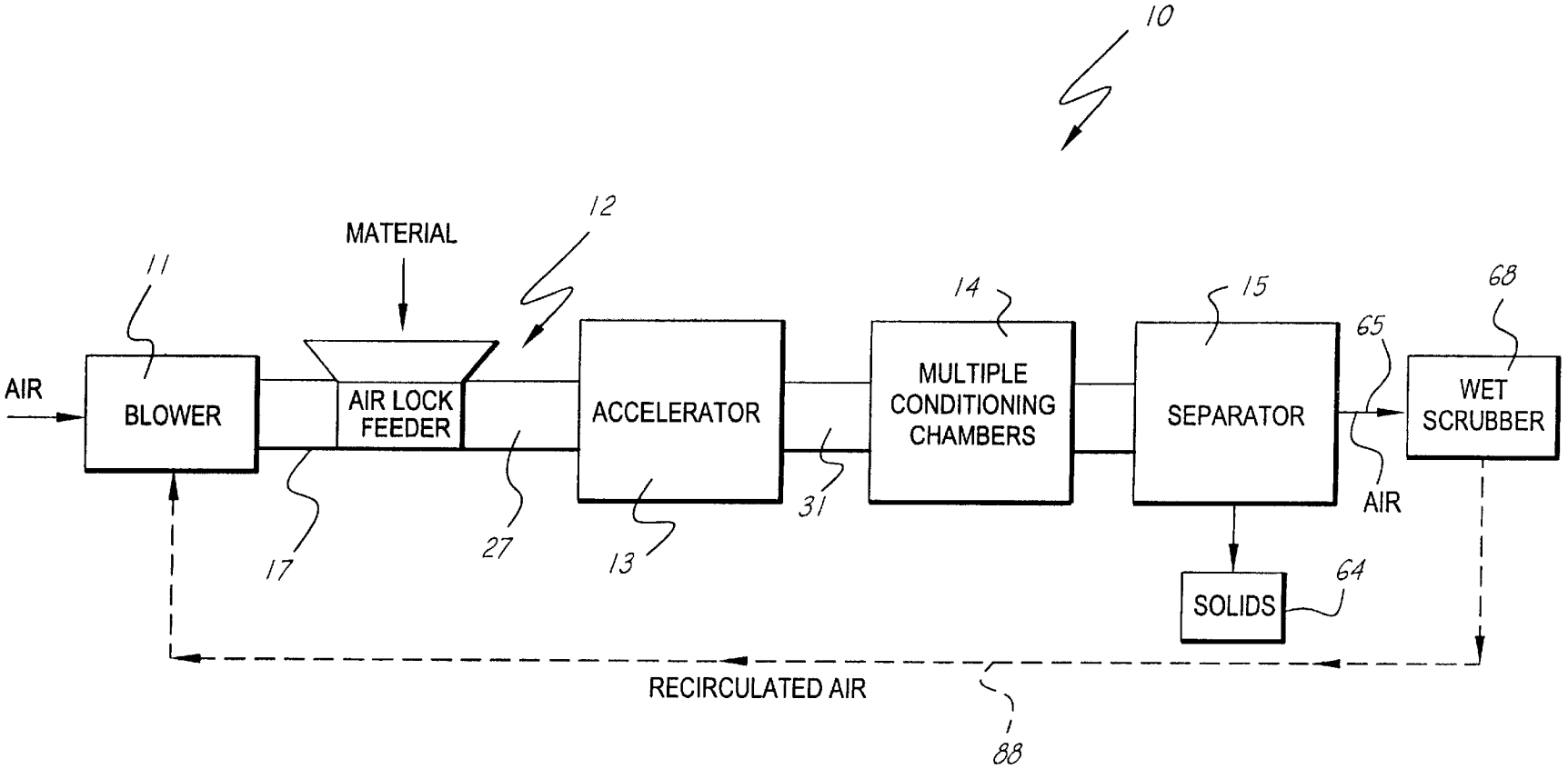
FIG. 1 is a schematic view of exemplary apparatus according to the present invention for practicing the exemplary method according to the present invention.
Figure 2:
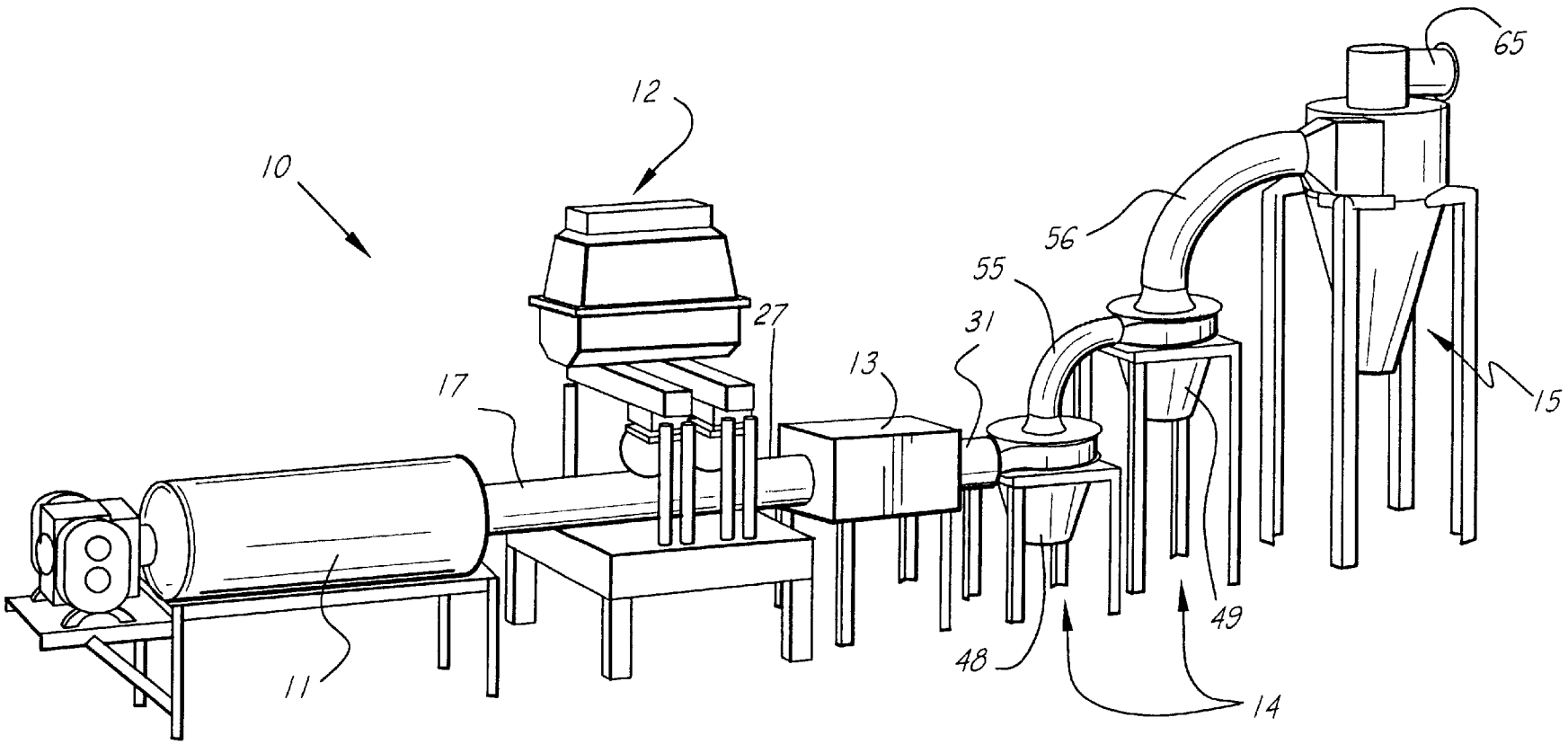
FIG. 2 is a perspective more realistic exterior view of the apparatus of FIG. 1.
Figure 3:
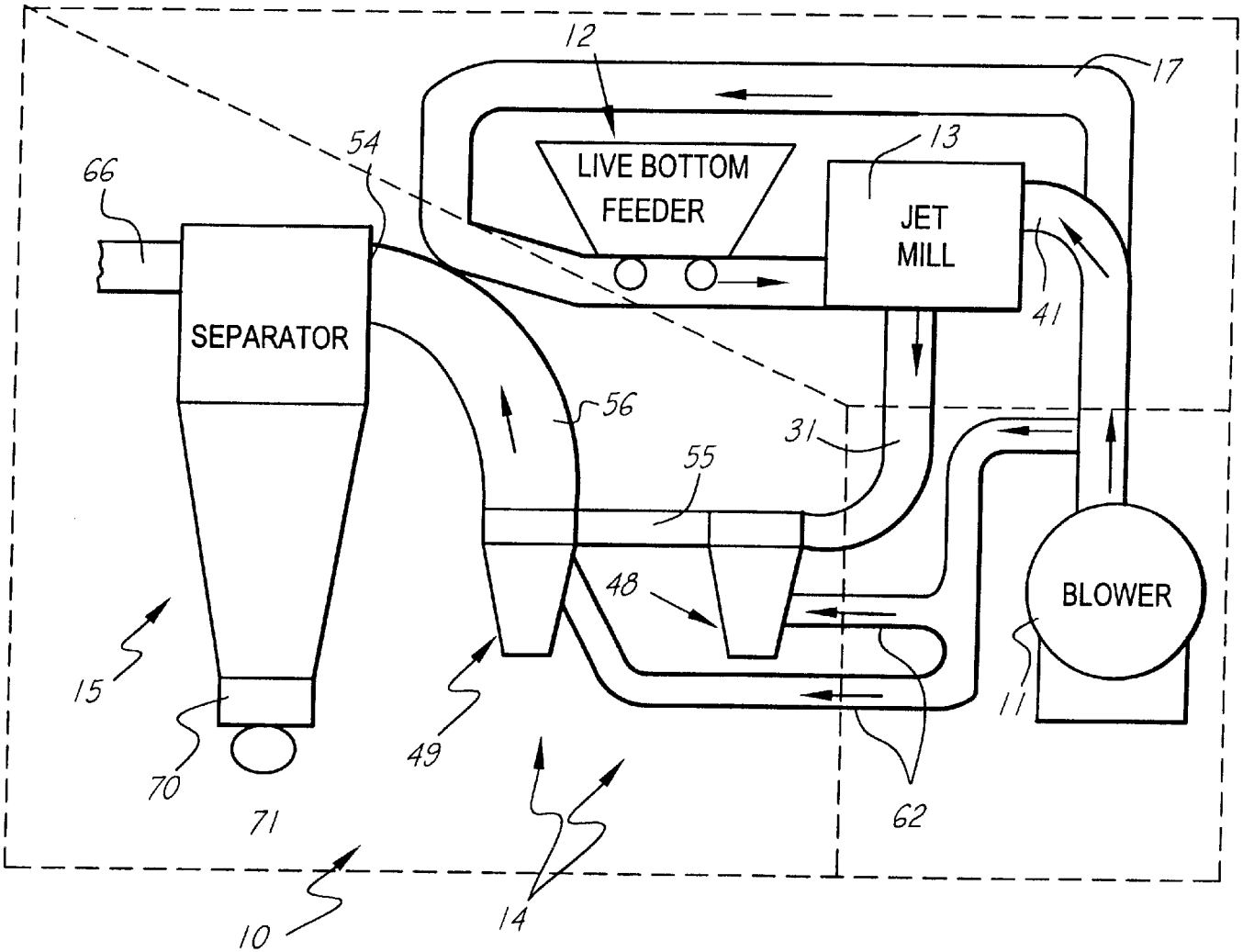
FIG. 3 is a detailed flow schematic illustrating an exemplary interconnection between the components of the apparatus of FIGS. 1 and 2.

FIGS. 1 through 3 illustrate an exemplary apparatus system according to the present invention for drying and reducing the particle size of a material, such as manure, municipal sludge, coal and coal fines, wood waste, pulp and paper mill waste, mine tailings, dredge spoils, or combinations thereof. While the invention will be described primarily with respect to treatment of manure, it is to be understood that these other materials, or a wide variety of other materials which desirably need to have the moisture content thereof reduced, as well as the average particle size thereof reduced and the uniformity of the particle size enhanced, may be treated.

The exemplary apparatus according to the present invention is illustrated generally by reference numeral 10 in FIGS. 1 and 3. It comprises as major components thereof a blower 11, a conventional airlock feeder 12 or the special air lock feeder shown in FIG. 11 at 112, an accelerator (also called a jet mill) 13, one or more conditioning chambers for reducing particle size and facilitating drying 14, and a separator 15 for separating solids from gaseous flow.

The blower 11 is conventional, and generates a high velocity air flow, e.g. air at a velocity of typically about 100–200 mph. One example (only) of a blower 11 suitable for the purposes of the present invention is the Roots Blower, Model 14 AZRA5, manufactured by the Roots Dresser Company of Connersville, Ind.

Figure 4:
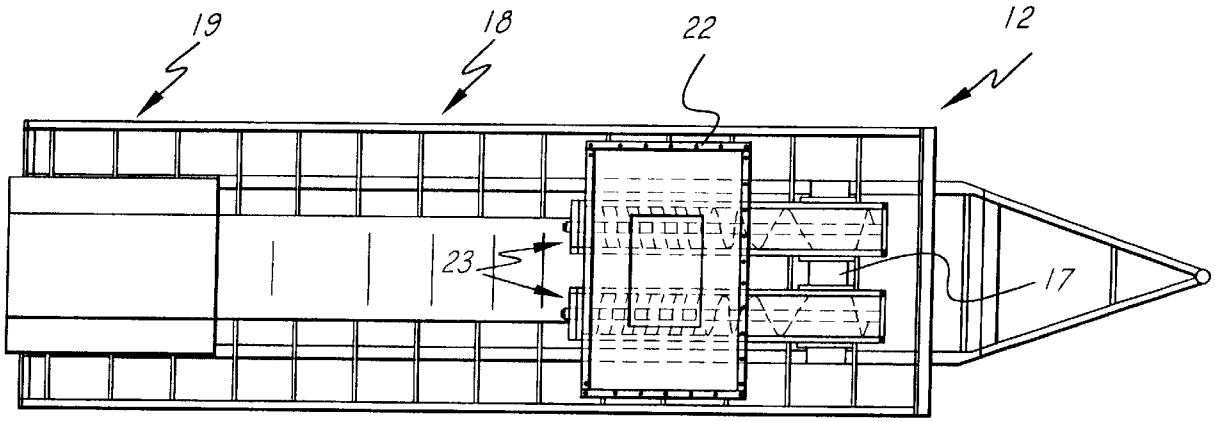
FIG. 4 is a top view of an exemplary airlock feeder utilized in the apparatus of FIGS. 1 through 3.
Figure 5:
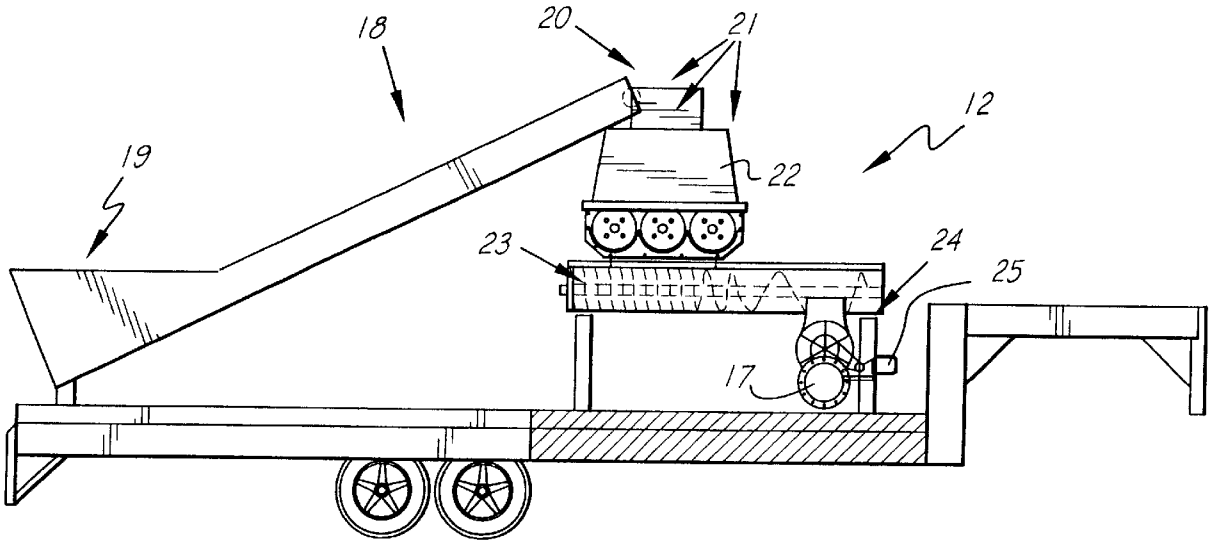
FIG. 5 is a side view of the airlock feeder of FIG. 4, showing the conduit from the blower in cross section.

The airlock feeder 12, 112, according to the present invention is connected via a conduit 17 to the outlet from the blower 11, and one form that the airlock feeder 12, 112 may take is illustrated in FIGS. 4 and 5. In FIGS. 4 and 5 the airlock feeder is shown mounted on a truck bed so that it is readily movable to the desired location, but it is to be understood that it could be mounted in a wide variety of other manners. The feeder 12 illustrated in FIGS. 4 and 5 comprises a conveyor 18 having an inlet 19 and an outlet 20 vertically above the inlet 19 for conveying the material (such as manure) into the open top 21 of hopper 22. The material falls out of the bottom of the hopper 22 (e.g. a live bottom hopper) into operative association with a pair of screw conveyors 23 which convey the material to a star feeder 24, also of conventional construction, having a star wheel that makes substantially sealing engagement with the surrounding housing. The star wheel is driven by a conventional motor 25, and when operating, feeds material into the high speed air flow within the conduit 17 so that the material is entrained in the air flow.

The material entrained in the high speed air flow passes through conduit 27 into the accelerator 13. An exemplary form that the accelerator 13 can take is illustrated in FIG. 6.

Figure 6:
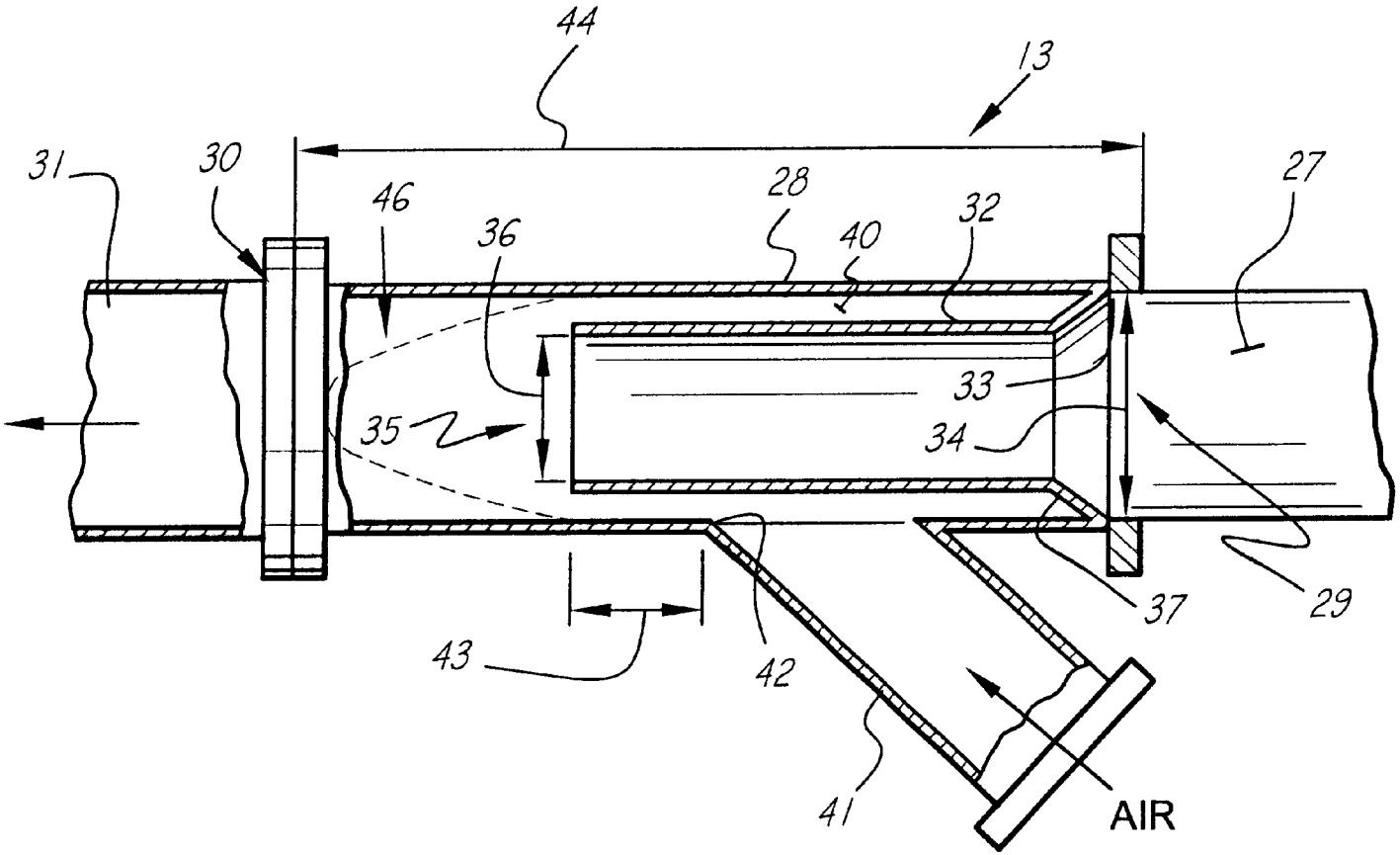
FIG. 6 is schematic side view, primarily in cross section and partly in elevation, of an exemplary accelerator (jet mill) for the apparatus of FIGS. 1 through 3.

In the embodiment illustrated in FIG. 6 the accelerator 13 comprises a housing 28 having a first open end 29 that is operatively connected, for example, through the conduit 27, to the conventional airlock feeder 12, and a second open end, schematically illustrated at 30 in FIG. 6, that is operatively connected to the conditioning chambers 14, for example via the conduit 31 illustrated in FIGS. 1 and 2. The accelerator 13 further comprises a central conduit 32 having a first end 33 at or adjacent the housing first end 29, having a first diameter 34, and a second open end, illustrated schematically at 35 in FIG. 6, within the housing 28, and having a second diameter 36 which is at least 10% less than the first diameter 34 (e.g. about 30–35% less). For example, the diameter 36 can be roughly ⅔ the diameter of the housing 28 and first end of the central conduit 32 (that is the diameter 36 is about ⅔ that of the diameter 34). A truncated cone portion 37 of the central conduit 32 is between the first and second diameter portions 33, 35 thereof.

The accelerator 13 preferably further comprises a substantially annular chamber 40 surrounding the second end 35 of the central conduit 32 within the housing 28, and a connection 41 from the blower 11 in the annular chamber 40 between the first and second ends 33, 35 of the central conduit 32. The connection 41 downstream-most portion 42 is spaced a distance 43 from the second end 35 of the central conduit 32 in the dimension of elongation of the housing 28. The distance 43 is preferably at least about six inches, for example for a housing 28 that has a length 44 that is about three feet.

The accelerator 13 increases the speed of the air flow with entrained particles from the conduit 27 to super-cyclonic speed, so that at least some of the particles are moving super-cyclonic speed, that is about 400–500 mph. In the preferred form, the accelerator 13 establishes a substantially bullet profile of air flow with entrained material, the bullet profile being shown very schematically at 46 in FIG. 6. The air flow profile 46 has a substantially zero velocity at the periphery thereof, immediately adjacent the interior of the housing 28, and a velocity of over about 400 mph at the center of the air flow, that is the center of the housing 28 as illustrated in FIG. 6 downstream of the second end 35 of the central conduit 32. Midway between the housing 28 wall and the center of the housing 28 the air flow speed of profile 46 may be approximately 250 mph.

The super-cyclonic speed air with entrained particles passes through the conduit 31 to the at least one particle size reducer and drier 14. Preferably two (or more) in-series conditioning chambers 48, 49 are provided as a size reducer and drier 14, a top outlet (primarily seen in FIGS. 2, 7 and 8) 51 from the first chamber or vessel 48 being connected to the inlet 52 for the second chamber or vessel 49, and the top outlet 53 from the second chamber or vessel 49 being connected to the inlet 54 of the particle separator 15. The inlet 50 to the first vessel 48 is tangential, as seen clearly in FIGS. 7 and 8, and each of the vessels 48, 49 is generally cyclone-shaped. The second vessel inlet 52 is vertically above the outlet 51 from the first vessel 48, e.g. about 1–4 feet, and the first conduit 55 connecting them is generally curved, e.g. in the embodiment illustrated in FIG. 8 having a radius of about 28 feet. The inlet 54 for the separator 15 is also vertically above the outlet 53 from the second vessel 49, e.g. about 3–6 feet, and the second conduit 56 interconnecting the outlet 53 and the inlet 54 is also generally curved, as seen most clearly in FIGS. 2 and 8. All of the inlets 50, 52, 54 are tangential, imparting a whirling action to the air with entrained particles introduced into each of the vessels 48, 49 and the separator 15. The second conduit 56 preferably has a larger diameter (e.g. by at least 10%) than the first conduit 55.

Figure 7:
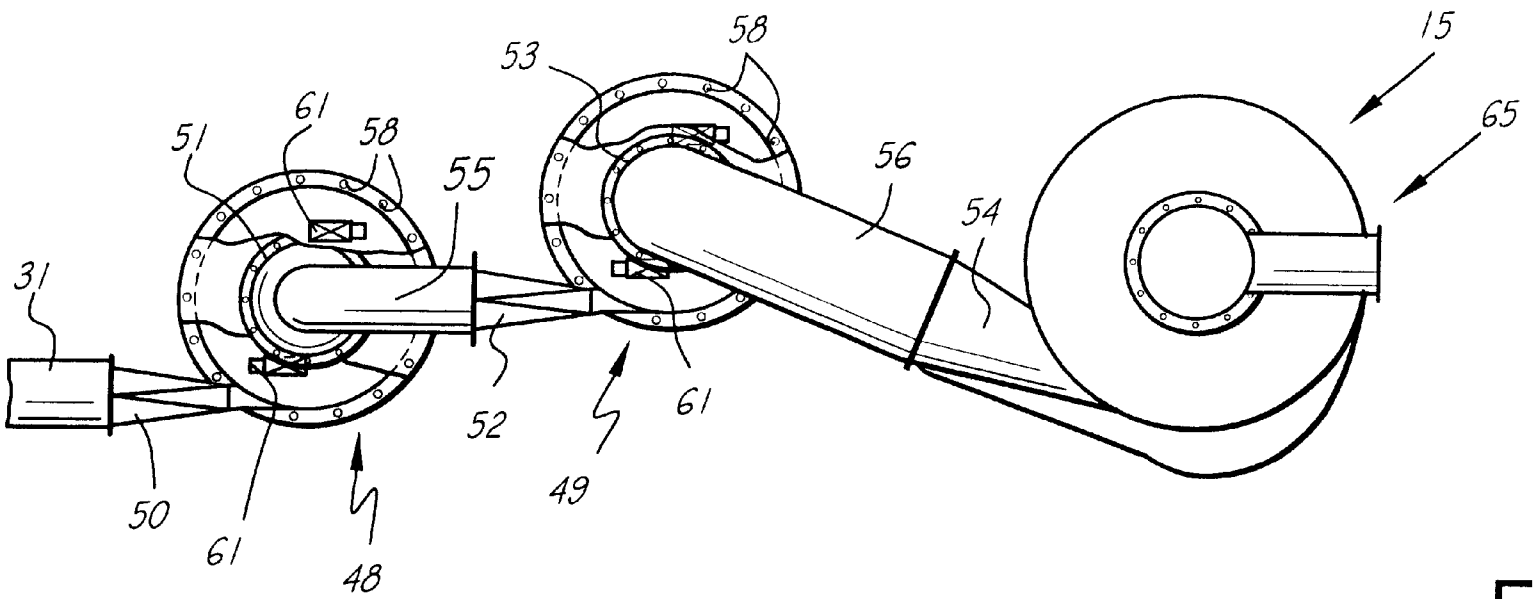
FIGS. 7 and 8 are top and side views, respectively, of the preferred embodiment of the multiple conditioning chambers and separator of FIGS. 1 through 3.
Figure 8:
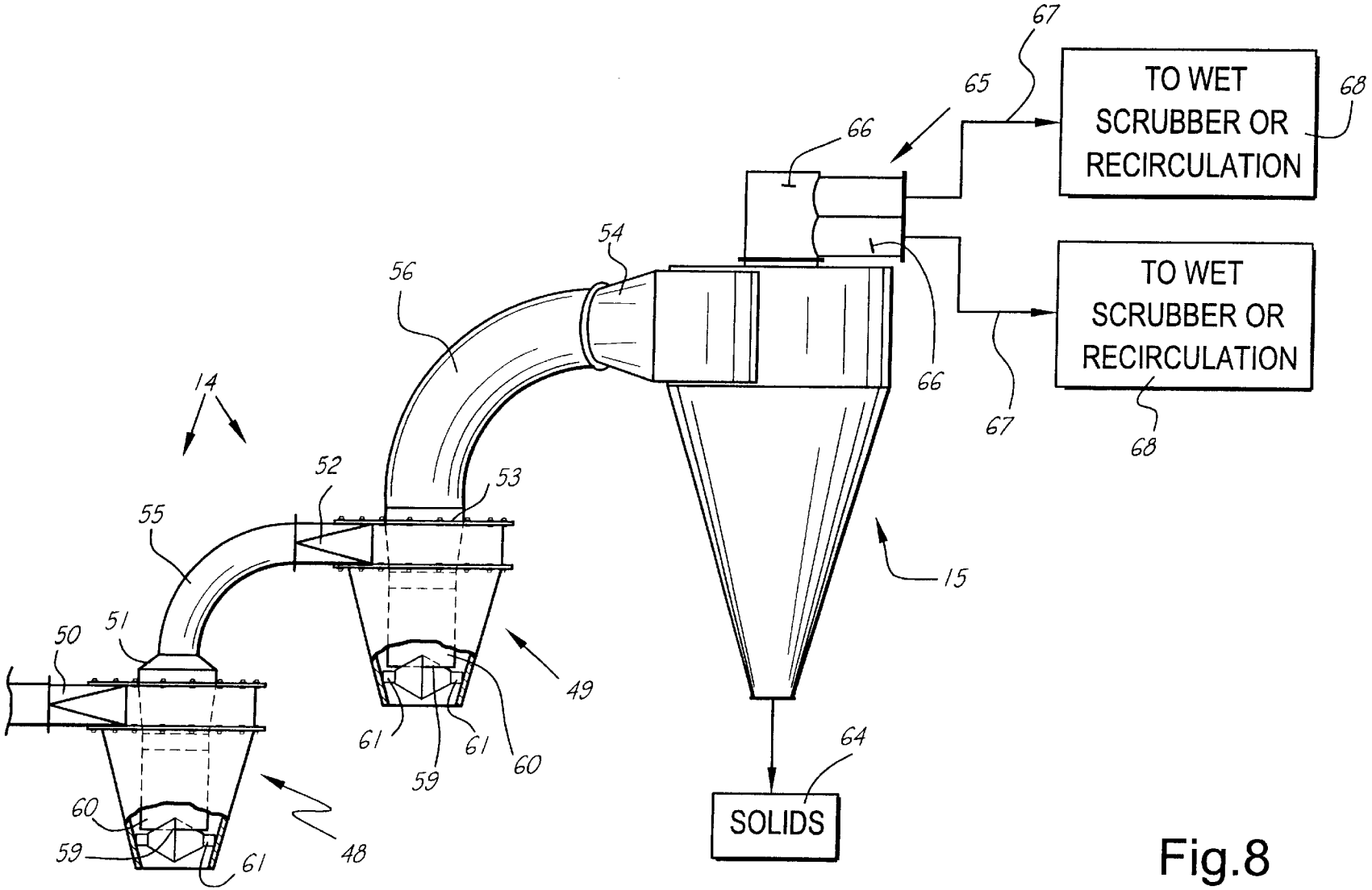

In the preferred embodiment illustrated most clearly in FIGS. 7 and 8, each of the generally cyclone-shaped vessels 48, 49 has directional breaker bars 58 mounted therein which create small turbulent areas so that new incoming solids entrained in the air have particle-to-particle collisions with solids already in the chamber 48, 49, for example at an impact angle of about 60°. This results in particle size reduction (and moisture release), and ultimately the smaller size particles pass through the open bottom 59 of the central tube or sleeve 60 in each of the chambers 48, 49 (see FIG. 8) to pass to the respective outlet conduit 55, 56.

The longer the particles are within a chamber 48, 49, the more particle-to-particle collisions that there are, and the greater the size reduction will be. The retention time within the chambers 48, 49 can be adjusted by utilizing valved auxiliary air inlets 61 (see FIGS. 7 and 8) adjacent the bottom of each of the vessels 48, 49, and/or by adjusting the effective length of sleeves 60.

The valved inlets 61 are connected to conduits 62 (see FIG. 3) extending from the blower 11. By adjusting the positions of the valves for the inlet 61 the amount of auxiliary air introduced into the bottoms of the vessels 48, 49 can be adjusted, and thereby the retention time adjusted depending upon the particular material involved and the desired final material to be produced, the number of the chambers 48, 49, etc. By increasing the auxiliary air flow through the valved inlet 61 retention time within the chamber 48, 49 can be increased. In addition to or in place of adjustment using the inlets 61, the residence time may be adjusted by adjusting the effective lengths of the sleeves 60 (see FIG. 8). The adjustment of sleeves 60 may be in any suitable conventional manner, such as by providing two or more telescopic elements as the sleeve 60, the elements held in a position to which they are adjusted by friction or one or more set screws.

The arrangement between the vessels 48, 49 and the particle separator 15 such as illustrated in FIGS. 2, 7, and 8 is provided in order to minimize the height of the entire apparatus 10, and in order to provide a proper air cushion during use. The proper cushion may not be provided if the conduits 55, 56 are not appropriately curved, such as illustrated in FIG. 8. Also the components are configured so that the super-cyclonic speed air flow into the inlet 50 to the first chamber 48 ultimately is reduced to approximately cyclonic speed in the conduit 56, which has a much larger diameter than the conduits 31 and 55. In the separator 15 the air speed is typically about 150–180 mph.

The separator 15 comprises a primarily conventional cyclonic separator, in which air with entrained particles swirls within the separator 15, after being tangentially introduced by inlet 54, with the particles being discharged from the bottom as illustrated at 64 in FIGS. 1 and 8, and with the moisture laden air which entrain the particles being discharged through an outlet shown schematically at 65 in FIGS. 1, 2, 7 and 8. In the embodiment illustrated in FIG. 8 the outlet 65 is illustrated as being defined by two smaller conduits 66, each connected by a conduit 67 to a wet scrubber 68 or other air treatment system. The two conduits 66 are provided so as to retain the flexibility of using two smaller footprint wet scrubbers 68 when the apparatus 10 is mobile. However, where desired a single discharge conduit 66 may be provided, connected up to a single wet scrubber 68 or the like. Other treatments can be performed on the air discharged from the conduit 66 aside from wet scrubbing, depending upon the nature of the air, the environmental conditions where the apparatus 10 is being used, and the like.

Figure 9:
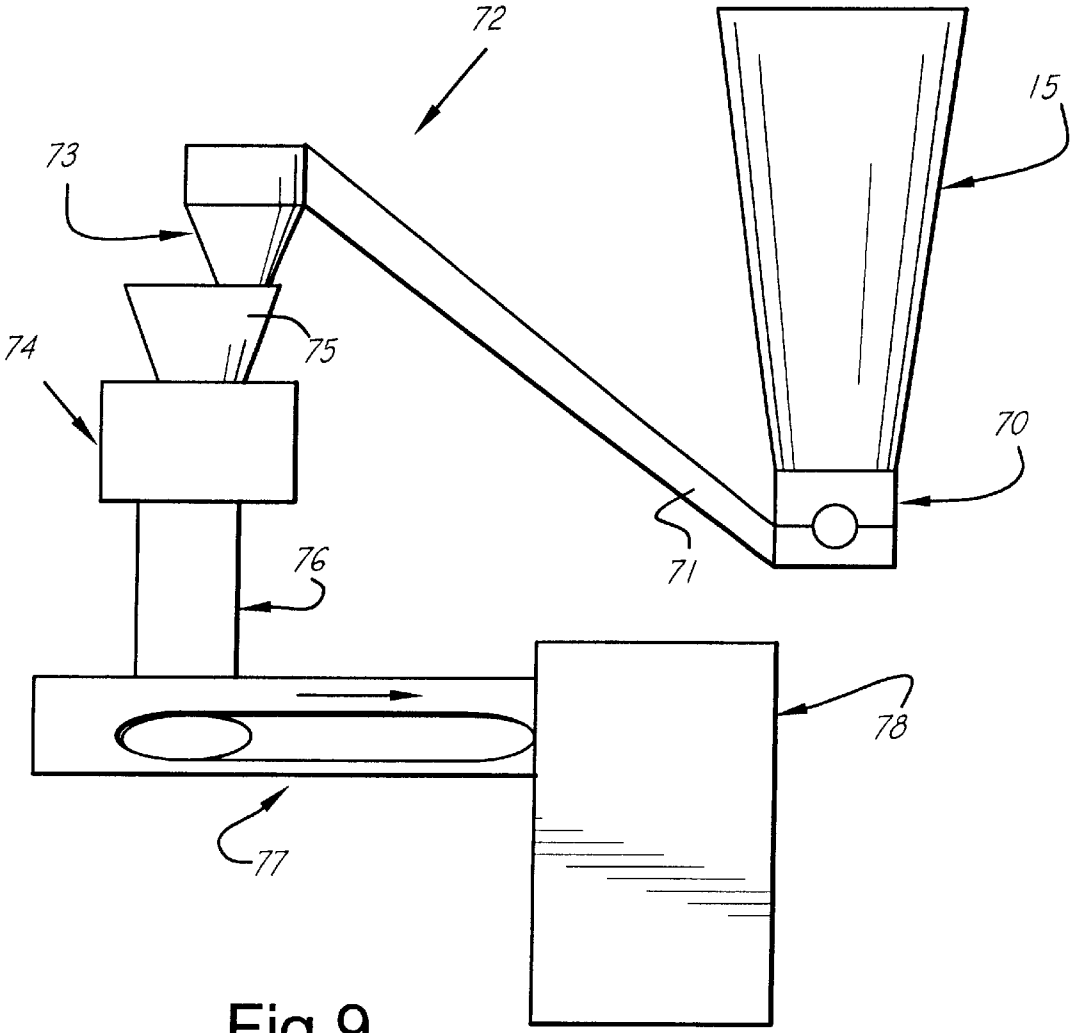
FIG. 9 is a schematic view of an exemplary system that may be utilized to produce granules from the output of the apparatus of FIGS. 1 through 3.

FIG. 9 schematically illustrates an exemplary system for handling the solids (the solids discharge being schematically illustrated at 64 in FIGS. 1 and 7) from a separator 15. As illustrated in FIG. 3, an airlock 70 may be provided at the bottom of the separator 15 to periodically discharge the dried and pulverized particles from the separator 15, and may be discharged into any suitable conventional conveyor 71, which cooperates with a system 72 (see FIG. 9) for producing granulated organic material from the solids 64 discharged from the separator 15.

For example, for the exemplary embodiment schematically illustrated in FIG. 9, the conveyor 71 is a screw type conveyor which transports the dry particulates to an input hopper 23 associated with a conventional roll compactor 74 having an input feeder 75. The conventional compactor 74 operates to form briquettes from the intermediate dry particulates. One example of a roll compactor suitable for the purposes of the present invention is the Betex Briquetter, Model 150 MS, manufactured by the Fitzpatrick Company of Elmhurst, Ill. After forming the dry particulates into briquettes, the briquettes are transferred to a conventional grinder 76 operative to reduce the briquettes to organic granules of a desired size. One example of a grinder suitable for the purposes of the present invention is the Fitzpatrick Fitzmill, Model OK.A S012, also manufactured by the Fitzpatrick Company of Elmhurst Ill. Upon exiting the grinder 76, the organic granules are placed on a conventional conveyor 77 and transferred to a conventional automatic bagging machine 78. In a preferred embodiment, the conveyor 77 comprises a vibrating screen that is operative to separate those organic granules having a size less than a desired size, so that only organic granules having a dimension greater than or equal to the desired size are transported by the conveyor 77 to the automatic bagging machine 78. One example of an automatic bagging machine 78 suitable for the purposes of the present invention is the St. Regis Auto Bagger, Model 3000, manufactured by the Fitzpatrick Company of Elmhurst, Ill.

Other ways of handling the solids discharge from the separator 15 may also be provided depending upon the material being treated, the desired size of the final product, and a number of other factors.

By practicing the invention it is possible to reduce the moisture content of the feed material by at least 20%, and typically to less than about ¼ of the original moisture content, while at the same time significantly reducing the average particle size, and making the particle size more uniform. This is also typically done without any external heat source, or if a heat source is provided only minimal heat is provided (for example the air introduced into the blower 17 may be heated), and at least in part because there is no need for significant heating of the air, the organic content of the final product is substantially the same as the original organic content, certainly no more than about 15% less. The following table gives two examples of the moisture content and organic content of poultry manure and cattle manure treated utilizing the apparatus 10 according to the present invention, without any external heat source:

TABLE 1

| | Moisture Content | | Organic Content | |
|---|---|---|---|---|
| | Raw | Treated | Raw | Treated |
| Poultry Manure | 85% | 12% | 72% | 69% |
| Cattle Manure | 45% | 10% | 34% | 30% |

As can be seen from Table 1, for the poultry manure the second moisture content (of the treated material) is only about 14% of the first moisture content (that of the input material) while for cattle manure the final moisture content is only about 22% of the initial moisture content. However, the organic content of the poultry manure when treated is more than 95% of that of the input material, while for cattle manure the organic content of the treated product is about 88% that of the input material.

Figure 10:
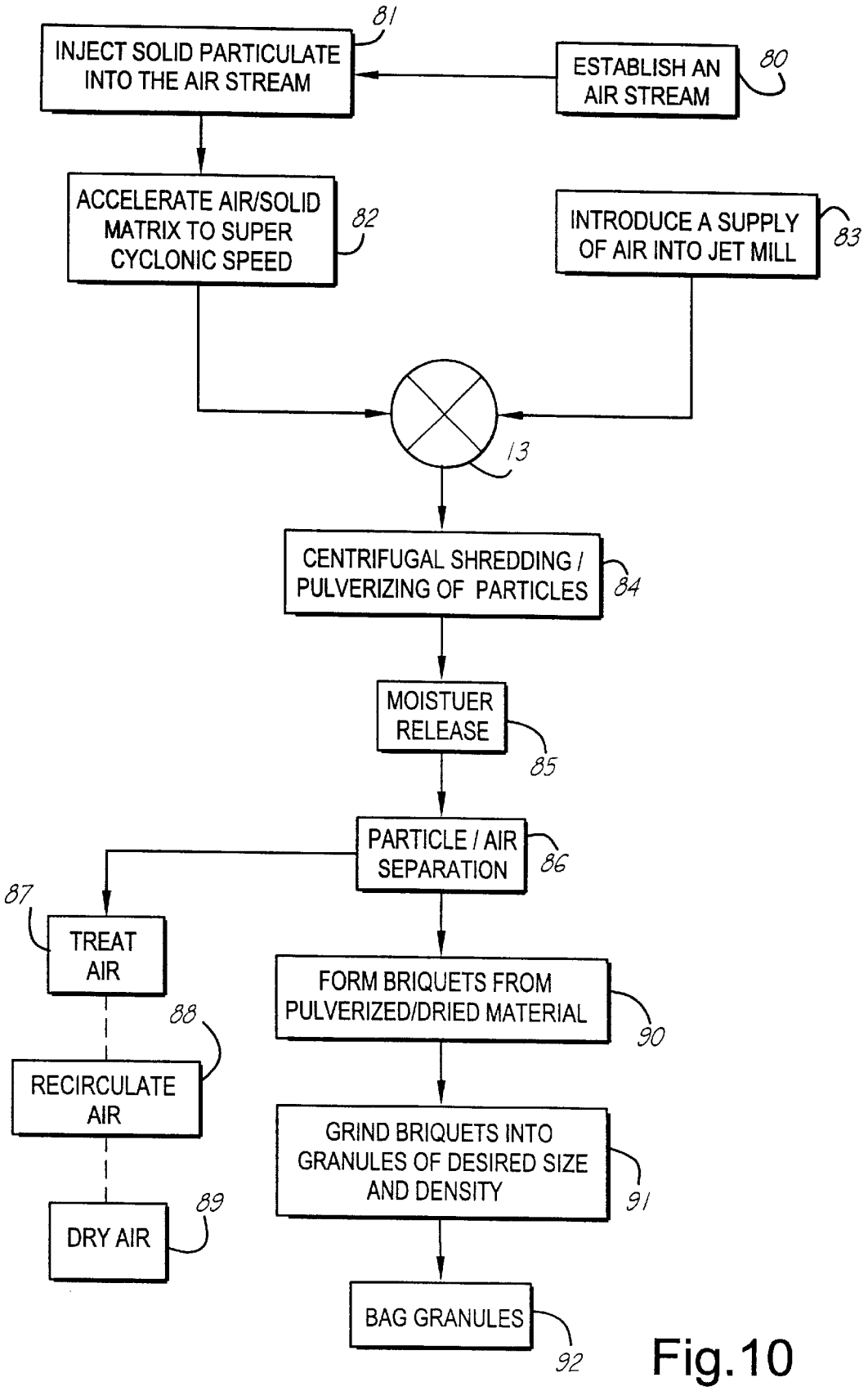
FIG. 10 is flow sheet illustrating an exemplary method according to the present invention.

FIG. 10 schematically illustrates an exemplary method according to the present invention utilizing the apparatus 10 heretofore described.

As indicated by box 80, an air stream is established, such as by using the blower 11. As indicated by box 81, the material to be treated having a first moisture content and first average particle size is fed (by feeder 12) into the air stream from 80 to entrain the material in the air stream. Then as illustrated by box 82 the speed of the air flow with entrained particles is increased (e.g. in accelerator 13) so that the speed is super-cyclonic (typically about 400–500 mph) and at least some of the particles are at super-cyclonic speed. As indicated by box 83 in FIG. 10, a supply of air (e.g. from blower 11), not at super-cyclonic speed, but at high speed (e.g. 100–200 mph), is introduced by conduit 41 into the substantially annular volume surrounding the central conduit 32, and a bullet profile 46 is preferably established, having a substantially zero velocity at the periphery of the air flow, a velocity of over about 400 mph at the center of the air flow, and typically a speed approximately midway between the periphery and the center of about 225–275 mph.

From the accelerator 13, as schematically illustrated at 84 in FIG. 10, the solid particles entrained in air are fed to the conditioning chambers 48, 49 where the particles swirl in the interior of the chambers 48, 49, impacting the directional breaker bars 58, and sustaining numerous particle-to-particle collisions, with the particle-to-particle collisions being primarily responsible for significantly reducing the average size of the particles, and making the average particle size more uniform.

During treatment, moisture from the particles is released into the air, the moisture release being illustrated schematically at 85 in FIG. 10. Further, moisture release occurs during separation of the particles and the air as illustrated schematically at 86 in FIG. 10, which takes place in the separator 15 in the preferred embodiment of the apparatus 10 illustrated in the drawings.

As illustrated schematically in FIGS. 10 and 1, the air from the separation stage 86 may be treated as indicated at 87, e.g. in a wet scrubber, and optionally, depending upon the particular equipment used, the material being treated, and other factors, at least a majority of air can be recirculated as illustrated at 88, e.g. back to the blower 11 (see FIG. 1). The recirculated air can be dried before recirculation to the blower 11, as illustrated schematically at 89 in FIG. 10, e.g. by passing it through a desiccant, by heating, or by treating in any other suitable conventional manner.

The particles separated in the separation stage 86, which have a much lower moisture content, a much smaller particle size, and more uniform particle size, without a significant decrease in organic content, can be formed into briquettes as schematically illustrated by stage 90 in FIG. 10, the briquettes can be ground as schematically illustrated at 91, and then bagged as schematically illustrated at 92, such as by using the equipment of FIG. 9.

Figure 11:
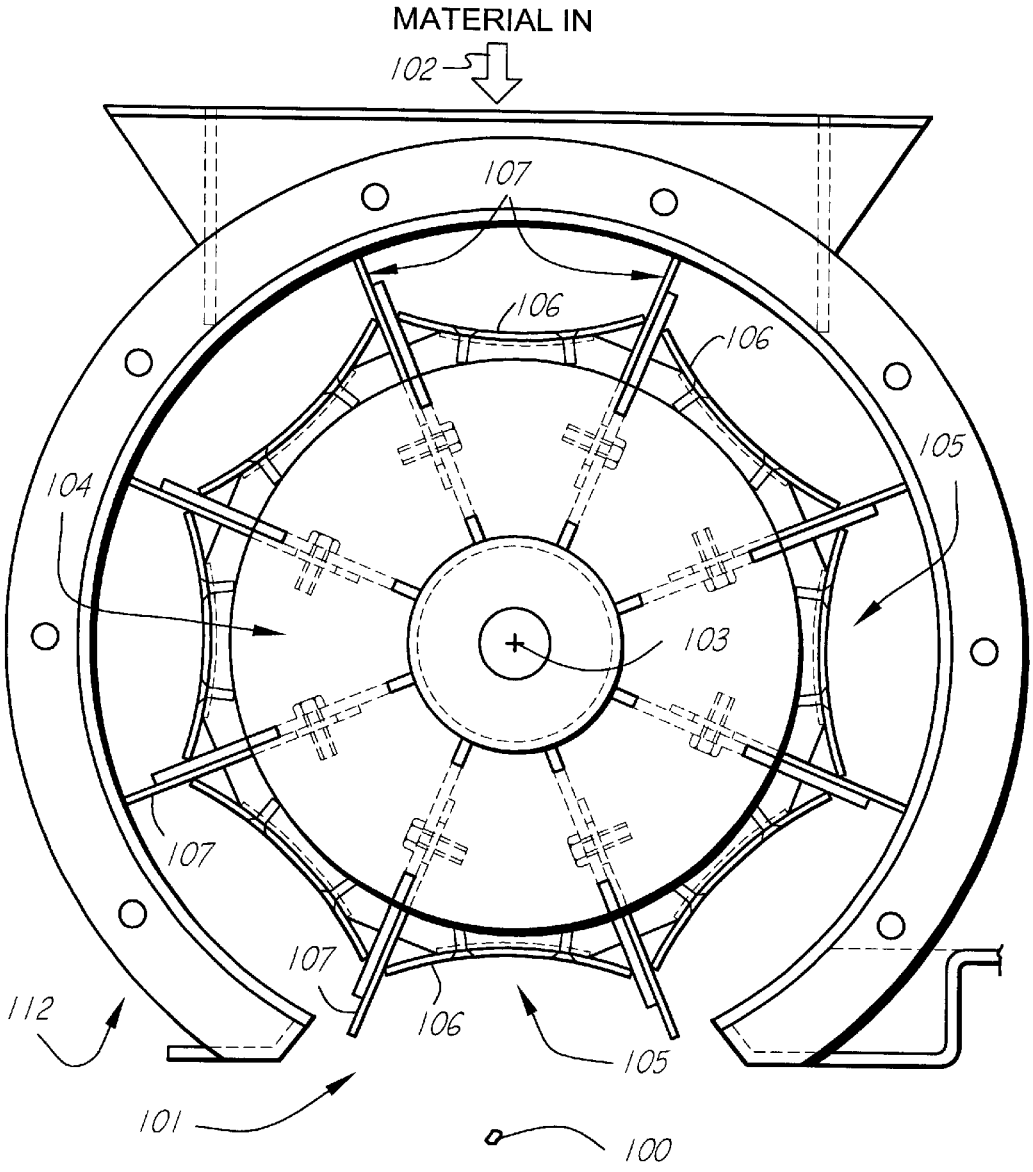
FIG. 11 is an end view, with the housing near wall removed for clarity of illustration, of a unique air lock feeder that may be used in the system of the invention.

Instead of a conventional feeder 12, the unique air lock feeder 112 of FIG. 11 may be used in the practice of the invention. For the feeder 112 the direction of air flow 100 entraining material discharged at the bottom 101 of feeder 112 is substantially perpendicular to the infeed direction 102 (into the page in FIG. 11), and substantially parallel to the axis of rotation 103 of the wheel 104. This allows the air flow to scour the exposed pocket 105 at the bottom 101, to help keep the pockets 105 free of sticky material.

Also, in the feeder 112 the pockets 105 are preferably shallow, e.g. about one third the possible volume, because curved false bottoms 106 are provided between the radially extending adjustable length paddles 107. This is done to minimize build up of sticky material. To make up for the shallowness of pockets 105, the wheel 104 may be rotated about axis 103 at an increased rpm (e.g. about 2–6 times as fast as conventional).

The invention specifically comprises all narrower ranges within a broad range. For example, reducing the moisture content by at least 20% means by 30–50%, 50–99%, 60–80%, and all other narrower ranges within the broad range.

It will thus be seen that according to the present invention a relatively simple, yet effective and cost effective, method and apparatus are provided for drying and reducing the size of malleable material, such as manure, municipal sludge, coal and coal fines, food waste, pulp and paper mill wastes, mine tailings, dredge spoils, or combinations thereof. While the invention has herein been shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A material drying and particle size reducing apparatus, comprising:

a blower;

an air lock feeder operatively connected to receive air from said blower and downstream thereof, said air lock feeder including a rotatable feeder wheel with a plurality of circumferentially spaced, radially extending paddles that define pockets therebetween for receiving the material, wherein an air flow direction from said blower is substantially perpendicular to an infeed direction of the material and substantially parallel to an axis of rotation of said feeder wheel;

an accelerator for increasing the speed of air flow from said blower, with entrained material from said air lock feeder;

at least one particle size reducer operatively connected to said accelerator downstream thereof; and a separator for separating reduced average particle size and drier material from the air flow, said separator operatively connected to and downstream of said at least one particle size reducer.

2. Apparatus as recited in claim 1 wherein said accelerator comprises: a housing having a first open end operatively connected to said air lock feeder, and a second open end operatively connected to said at least one particle size reducer; a central conduit having a first end at or adjacent said housing first end, having a first diameter, and a second open end within said housing having a second diameter at least 10% less than said first diameter; and a truncated cone portion of said central conduit between said first and second diameter portions thereof.

3. Apparatus as recited in claim 2 wherein said accelerator further comprises a substantially annular chamber surrounding said second end of said central conduit within said housing, and a connection to said blower in said annular chamber between said first and second ends of said central conduit and at least about six inches from said central conduit second end.

4. Apparatus as recited in claim 1 wherein said at least one particle size reducer comprises at least first and second cyclone-shaped vessels connected in series, said first cyclone-shaped vessel between said second cyclone-shaped vessel and said accelerator; and wherein said vessels each have an inlet and an outlet; and wherein said second vessel inlet is vertically above said first vessel inlet and said first vessel outlet is connected by a first curved conduit to said second vessel inlet.

5. Apparatus as recited in claim 4 wherein said separator comprises a cyclone-shaped separator vessel with a particle outlet at a bottom portion thereof and an inlet at a top portion thereof; and wherein said separator vessel inlet is vertically above said second particle size reducer vessel and connected thereto by a second curved conduit having a larger diameter than said first curved conduit.

6. Apparatus as recited in claim 5 further comprising first and second air outlets from a top portion of said separator vessel, above said separator vessel inlet.

7. Apparatus as recited in claim 4 further comprising valved auxiliary air inlets to bottom portions of said first and second vessels, said auxiliary air inlets operatively connected to said blower, and adjustable effective length central sleeves in said first and second vessels.

* * * * *